United States Patent [19]

Perondi

[11] 4,006,704

[45] Feb. 8, 1977

[54] STRAIGHT LINE GLUER

[75] Inventor: Giorgio Perondi, Milanino, Italy

[73] Assignee: FMC Corporation, San Jose, Calif.

[22] Filed: Apr. 10, 1975

[21] Appl. No.: 567,042

Related U.S. Application Data

[63] Continuation-in-part of Ser. No. 497,008, Aug. 13, 1974, abandoned.

[52] U.S. Cl. ..... 118/50; 118/62; 118/236; 118/246; 118/247; 118/245

[51] Int. Cl.[2] ..... B05C 1/02

[58] Field of Search ..... 118/262, 6, 236, 500, 118/246, 247, 50, 62, 245; 271/106, 196, 197; 198/184

[56] References Cited

UNITED STATES PATENTS

| | | | |
|---|---|---|---|
| 1,565,830 | 12/1925 | Thoma | 118/246 |
| 1,772,344 | 8/1930 | Federwitz | 118/262 |
| 2,520,768 | 8/1950 | Kunicki | 118/262 |
| 2,614,522 | 10/1952 | Snyder | 118/247 X |
| 2,661,716 | 12/1953 | Minkow | 118/246 X |
| 3,252,701 | 5/1966 | Andresen, Jr. et al. | 118/236 X |
| 3,321,121 | 5/1967 | Nyberg et al. | 271/197 X |
| 3,335,696 | 8/1967 | Faltin et al. | 118/245 X |
| 3,466,028 | 9/1969 | Bays | 271/106 X |
| 3,648,605 | 3/1972 | Hottendorf | 271/197 X |
| 3,861,351 | 1/1975 | Bonwit et al. | 118/50 X |
| 3,861,668 | 1/1975 | wood | 271/106 X |

*Primary Examiner*—John P. McIntosh
*Attorney, Agent, or Firm*—C. E. Tripp

[57] ABSTRACT

A gluing machine employs substantially linear conveying motion and has easily installed change parts, which adapt the machine to handle thin paper or relatively heavy cardboard. A vacuum head with compound motion delivers a sheet of cardboard or paper from a vertical stack by lifting the leading edge and advancing it substantially horizontally between drive rolls which deliver the sheet under a glue roll. A glue spreader roll is mounted on eccentrics for adjusting its spacing from the glue roll. For relatively stiff sheets, a pair of removable presser rolls under the glue roll continuously flex the moving sheet into close contact with the glue roll and the sheet is delivered onto a dual compartment vacuum conveyor for positive ejection and accurately timed delivery to a downstream processing station. The presser rolls are replaced with a fixed bridge for handling flexible sheets, and the vacuum head is rotated while in motion by an air cylinder carried on the support arms for the vacuum head. The air cylinder can be disabled for handling stiff sheets. Manually controlled air cylinders are provided for retracting the vacuum cups from the feed rolls and for lifting the upper feed roll in order to facilitate clearing jams.

6 Claims, 20 Drawing Figures

2E
2B
2D
2C
30
33b
32
32f
32h
32g
32b
32d
32c
32e
32a
33
33a
22

M1

83a
83b
83c
20
72
18
180
170
166
74
174
S
80
71
70
76
120
121
85
82
158
26
83
178
84
75
182
184
142
135
116
118
108
110

FIG_10
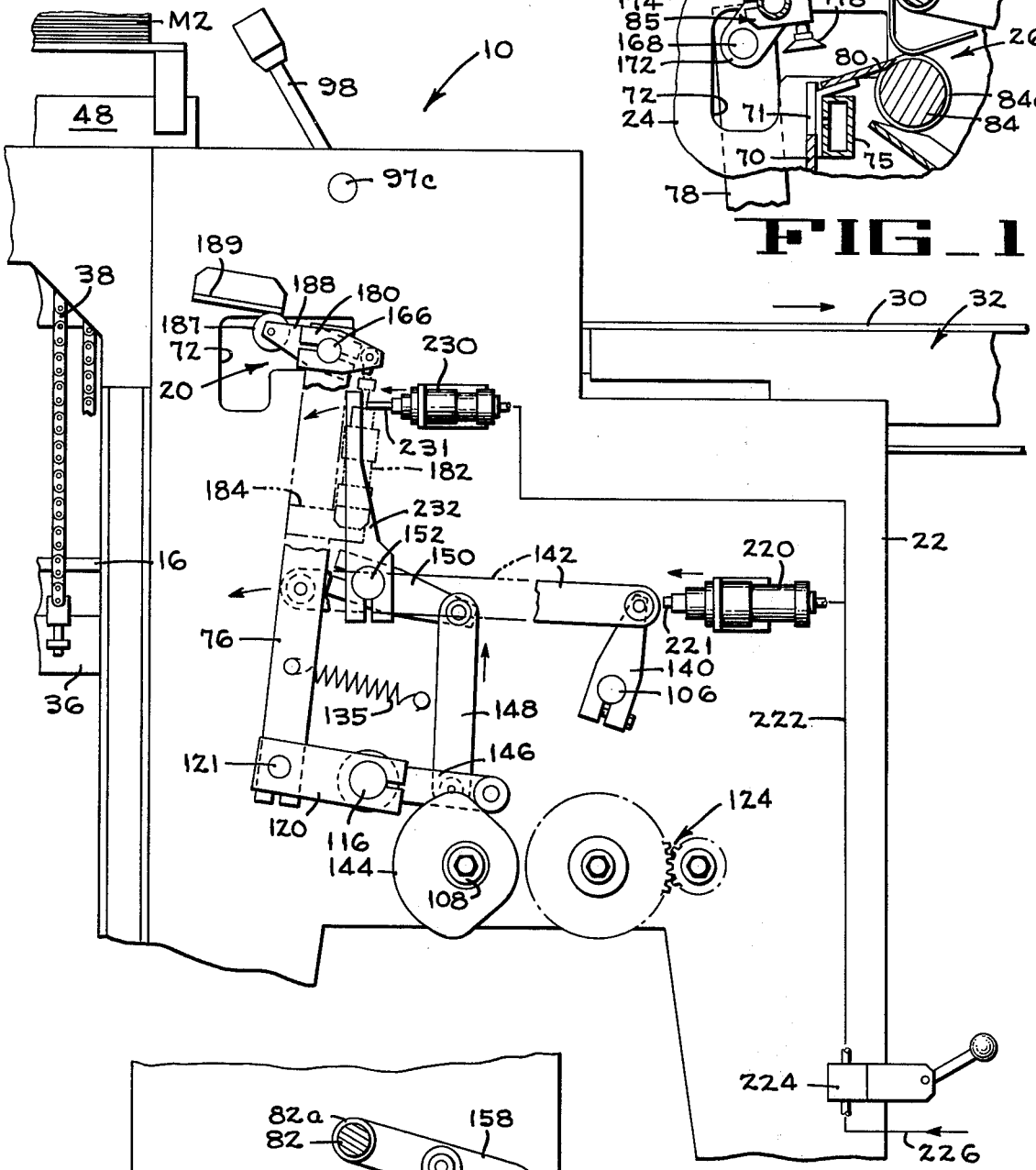
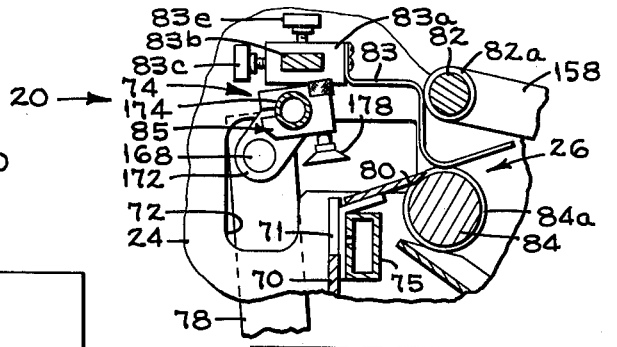
FIG_11
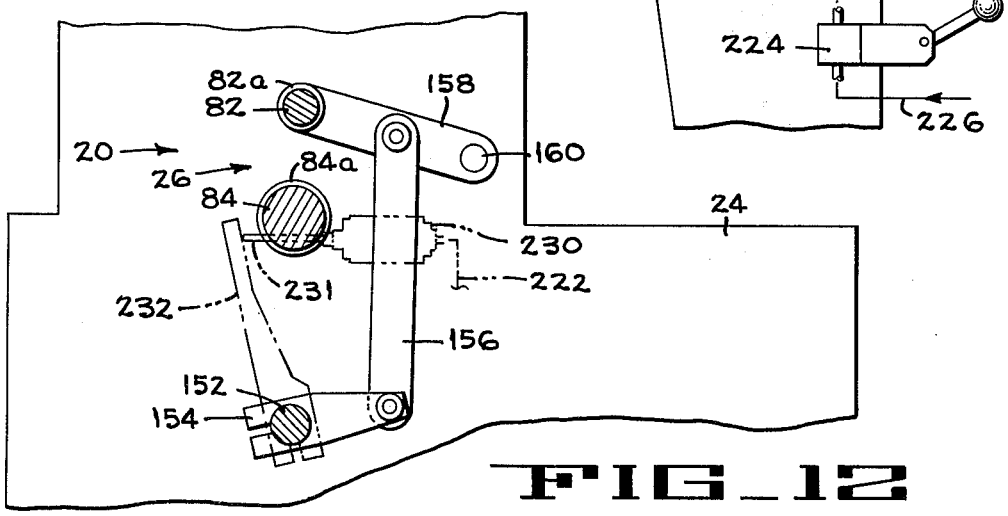
FIG_12

STRAIGHT LINE GLUER

This application is a continuation in part of Perondi, Ser. No. 497,008, now abandoned, filed Aug. 13, 1974 and assigned to the FMC Corporation.

The present invention concerns gluing machines for applying an adhesive coating to sheets of paper or cardboard. The present invention concerns a gluing machine which can be readily converted to handle either thin and flexible paper sheets, such as are used in box wrapping machines, or thicker and relatively inflexible cardboard sheets such as may be used in forming a laminated game board, boxes or the like.

A gluing machine is disclosed in the Andresen et al U.S. Pat. No. 3,252,701, issued on May 24, 1966, wherein sheets of paper are sequentially fed from a stack and upward past a glue roll. Above the glue roll, an air blast redirects the sheet back over a vacuum belt conveyor which overlies the supply stack. The sheets leave the magazine in one direction, and follow a recurved path onto a discharge conveyor belt. Such sheets must be very flexible, and stiff, relatively inflexible sheets cannot be used.

SUMMARY OF THE INVENTION

By a physical arrangement of operating components, as well as particular structural details, substantially straight line movement of the workpiece during glue application is feasible. This allows the gluing machine of the present invention to handle either very flexible sheets, sheets which are relatively inflexible, and sheets of intermediate flexibility. Certain easily interchangeable and removable parts are employed to adapt the gluing machine for optimum performance over a range of sheet flexibility, thus allowing one machine to have a broad range of usefulness. For example, the gluing machine can be used in laminating operations such as in the construction of game boards employing one or more thick and/or inflexible substrates. At the other extreme of operating conditions, thin, flexible wrappers or labels for paperboard boxes, or a cover sheet for a game board can be effectively handled by the machine after a simple and quick changeover. Thus, one general object of the invention is to provide a gluing machine which can apply adhesive to sheets of paper, or similar material, which sheets may have a wide range of stiffness or flexibility.

Another improvement relates to the vacuum belt discharge conveyor. The vacuum box of the vacuum conveyor is compartmentalized to form a longitudinally extending central or mid-compartment connected to one independent source of vacuum. The central compartment is flanked by side compartments that are in communication with one another and which are connected to a second independent source of vacuum. This construction makes it possible to convey both narrow and wide sheets while maintaining the degree of vacuum applied from each vacuum source lower than the degree of vacuum that would be required if a single source were connected to a vacuum box having a single, full width compartment.

Another feature of the present invention relates to the adjustment of a glue spreader roll adjacent the main glue roll. In the preferred embodiment, the spreader roll is mounted on levers which can be adjusted by an eccentric shaft so that rotation of the shaft by an adjustment handle precisely varies the spacing between the spreader roll and the main glue roll. The shaft can be clamped in its adjusted position. Another feature of the invention relates to the provision of spaced sheet guide fingers that ride in grooves formed in the upper feed roll, which fingers have that project toward the glue roll.

It is a feature of the invention that means are provided independently for retracting the vacuum cups and for raising the upper feed roll in order to facilitate clearing of jams that might arise occasionally. These provisions are under manual control of the machine operator.

BRIEF DESCRIPTION OF THE DRAWINGS

FIG. 10 is a side elevation showing the air cylinders used for clearing jams.

FIG. 11 is a view showing the vacuum cups retracted and raised.

FIG. 12 is a view showing the upper feed roll raised.

DESCRIPTION OF THE PREFERRED EMBODIMENT

Figure 1:
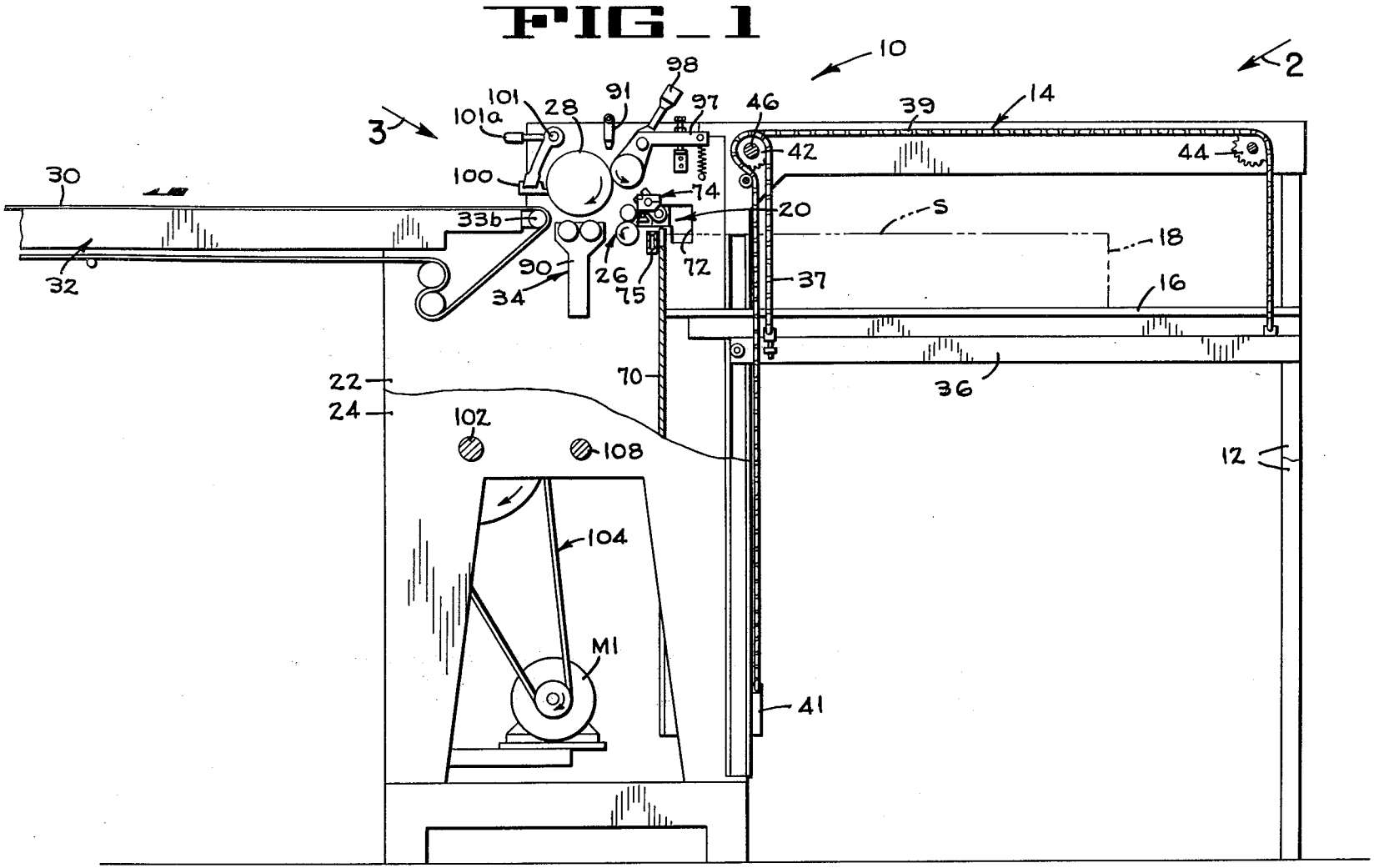
FIG. 1 is a schematic side elevation of the gluing machine of the present invention, partly broken away to show the upper portion thereof in longitudinal section.

The gluing machine 10 (FIG. 1) includes leg supports 12 for a stack magazine 14. The magazine 14 includes an elevator table 16 which is automatically raised to position the uppermost sheet S of a stack (indicated by phantom outline 18) of sheets in horizontal alignment with a sheet feeding mechanism 20. The sheet feeding mechanism is disposed between side plates 22 and 24, and is driven by a motor M1 to feed one sheet at a time between superposed feed rolls at 26. It will be understood that a clutch is usually interposed between the motor M1 and the parts driven thereby, but due to the schematic nature of the present drawings no clutch is illustrated.

From the feed rolls, the sheet progresses under a driven glue roll 28 and onto the upper reach of an elevationally adjustable vacuum belt conveyor 30 which overlies a vacuum box 32 and delivers the glue covered sheet to a further downstream processing station.

Figure 2:
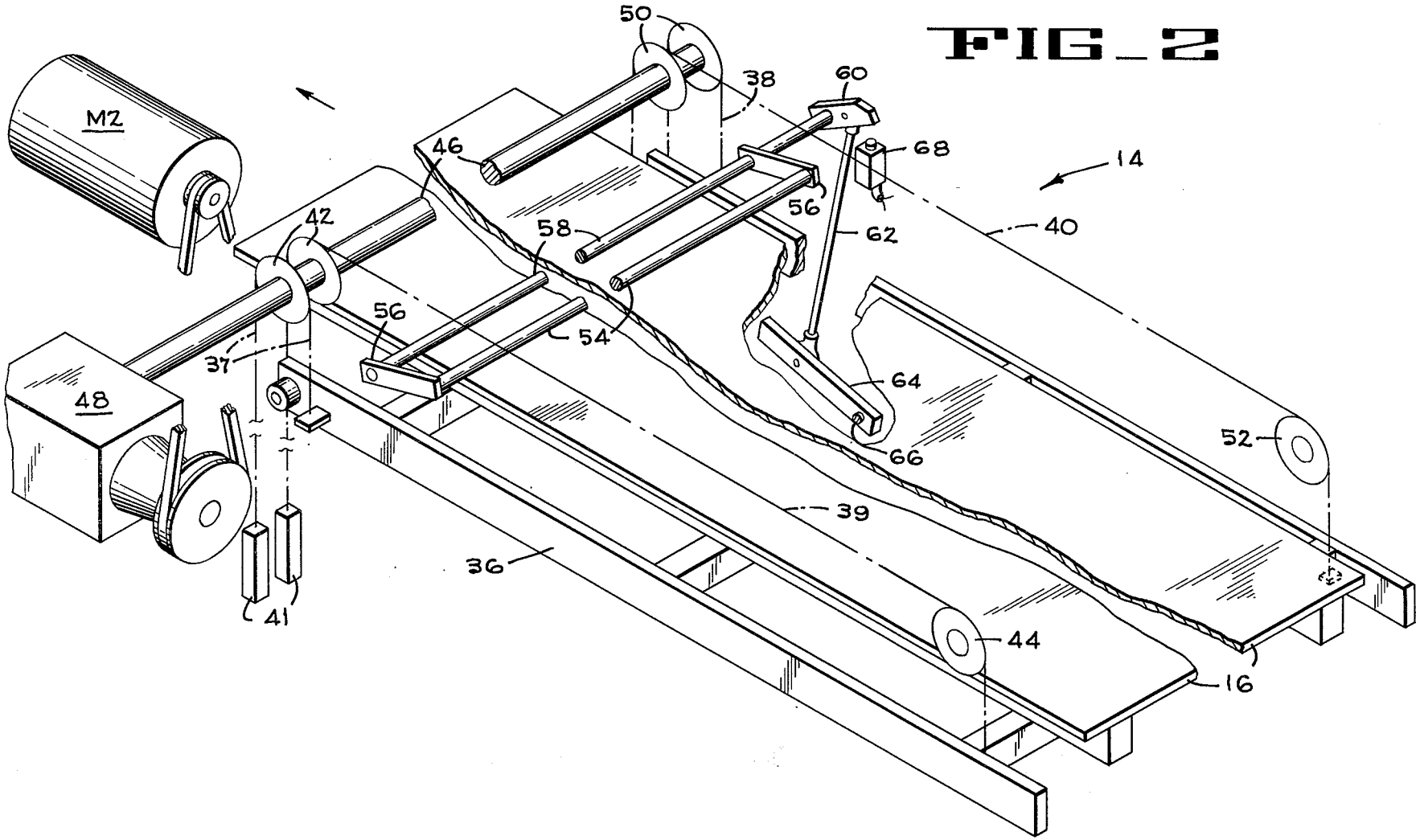
FIG. 2 is an enlarged schematic perspective of a stack magazine, the general area of which is indicated by the arrow 2 on FIG. 1.
Figures 2A, 2B, 2C, 2D, 2E:
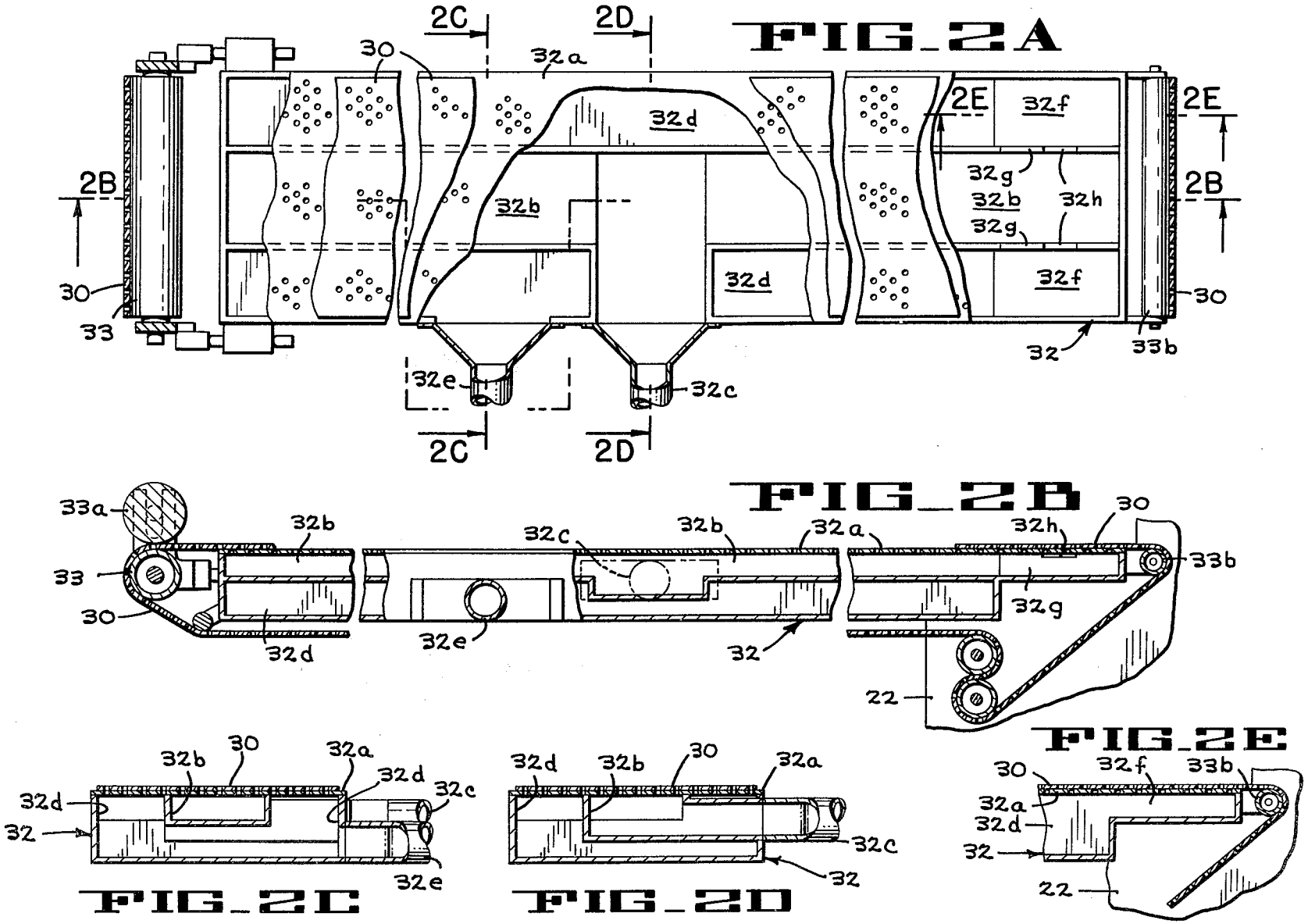
FIG. 2A is a plan view of the vacuum conveyor with parts broken away.
FIG. 2B is a section taken on line 2B of FIG. 2A.
FIG. 2C is a section taken on line 2C of FIG. 2A.
FIG. 2D is a section taken on line 2D of FIG. 2A.
FIG. 2E is a section taken on line 2E of FIG. 2A.

As seen in FIGS. 2B-2E, the vacuum box 32 is constructed to form longitudinal compartments, the purpose being to limit the vacuum required in the vacuum during handling of a range of widths of sheets or labels. The vacuum box 32 is covered with an apertured top plate 32*a* over which the apertured conveyor belt 30 slides for removing glued sheets from the gluer. The vacuum box is compartmentalized to form a longitudinal median or central compartment 32*b* flanked by side compartments 32*d*. The central compartment 32*b* as seen in FIGS. 2A and 2D, is connected to an outlet box leading to a pipe 32*c* which pipe is connected to one independent source of vacuum (not shown). As seen in the section of FIG. 2C, the two side compartments 32*d* are in communication with one another and have a pipe 32*e* for connection to another independent vacuum source, not shown. As seen in FIGS. 2A, 2B, the mid-compartment 32*b* is flanked, at the receiving end of the conveyor, by side walls 32*g* which are formed with small notches 32*h*, best seen in FIG. 2B. This establishes restricted communication between the central compartment 32*b* and the side compartments 32*f* to equalize the vacuum across the sheet at the sheet receiving end of the vacuum box. As seen in FIG. 2E, the reduced height side delivery compartments 32*f* are in open communication with the main side compartments 32*d* which, as previously mentioned in connection with FIG. 2C, flank the central compartment 32*b*. As mentioned, with this construction, the degree of vacuum applied to the vacuum connections 32*c* and 32*e* need only be sufficient to handle sheet areas that occupy substantially less than the entire width of the vacuum box. Thus, narrow sheets will be conveyed principally by the effects of the vacuum in the central compartment 32*b* and wider sheets will be conveyed by the aforesaid vacuum effects plus some or part of the vacuum in the side compartments 32*d*. The result of this construction is that neither of the vacuum connections 32*c*, 32*e* need be connected to a source of vacuum as high as would be required if the vacuum box were one, full width compartment. It is to be understood that stays and other reinforcements (not shown) can be included to resist the atmospheric pressure tending to collapse the vacuum box, this expedient being well known in the art and the details thereof are not critical to the present invention.

At the sheet delivery end of the vacuum box, the belt 30 is passed over a roller 33, above which is a gravity pinch roller 33*a*. At the receiving end of the belt 30, the belt passes over a roller 33*b*.

For handling relatively thick, inflexible sheets, a presser assembly 34 beneath the glue roll 28 mounts rolls which slightly curve the sheet to attain a relatively large contact area with the glue roll 28. When more flexible sheets are processed, the presser roll assembly 34 is modified by removing the rolls replacing them with a bridge 212 shown in FIG. 6. One feature of the present invention is that the sheets have substantially straight-line motion during transport from the stack magazine 14 to the vacuum belt conveyor 30 so that only minimal bending of the sheet is necessary, during its transport. Other features are that the presser assembly 34 and the sheet feeding mechanism 20 are readily converted for optimum performance with comparatively thick and thin sheets having a wide range of flexibility, and that the size range of the sheets that may be handled is large.

With reference to FIG. 2 and the stack magazine 14, the elevator table 16 is secured to a rectangular framework 36 that is supported at each corner by the vertical runs of conveyor chains 37, 38, 39 and 40 to elevate or lower the table 16 and maintain it level. Considering only the chains 37 and 39 at one side of the gluing machine, the arrangement of which is typical for the other chains, the chain 37 has a free end carrying a counterweight 41 and passes over a driven sprocket 42; the chain 39 is also provided with a counterweight 41, passes over a second driven sprocket 42 and is trained over a fixed idler sprocket 44 adjacent its point of attachment to the framework 36.

The driven sprockets 42 are mounted on the output shaft 46 of a gear box 48 that is powered by a reversible motor M2. Chains 38 and 40 are similarly mounted on driven sprockets 50, the latter chain being trained over an idler sprocket 52. Thus, powered rotation of the shaft 46 in one direction simultaneously raises each corner of the table 16 from a possible lowermost position near ground level. Assuming that a stack of sheets is on the table 16, and the upper sheet has been removed by the sheet feeding mechanism 20 (FIG. 1), as later described in detail, the stack is elevated to place the next sheet in feeding position by means including a stack-height sensor rod 54.

The sensor rod 54 is carried by arms 56 which are fixed to a control rod 58 that is pivotally mounted on fixed side plates (not shown). A lever 60 on one end of the control rod 58 is connected by a link 62 to a trip arm 64 that is pivotally mounted on a stub shaft 66. In a manner later described, the free end of the trip arm 64 is pivoted upward each time the sheet feeding mechanism 20 (FIG. 1) picks up a sheet from the stack and feeds it toward the glue roll 28. Then, the trip arm 64 is allowed to pivot downward, when the sheet feeding mechanism returns toward the magazine. Lowering of the trip arm 64 causes the lever 60 to actuate a microswitch 68 which energizes the motor M2 to elevate the stack. Lowering of the trip arm also lowers the stack sensor rod 54 to be lifted by the uppermost sheet of the rising stack of sheets on the table 16. Accordingly, the actuator 60 of the microswitch 68 opens the switch when the uppermost sheet is in feeding position, whereupon the motor M2 is de-energized.

A rear sheet separator mechanism (not shown), such as that disclosed in the pending application of Shelmire, Ser. No. 513,608, filed Oct. 10, 1974, and assigned to the FMC Corporation can be employed.

Figure 3:
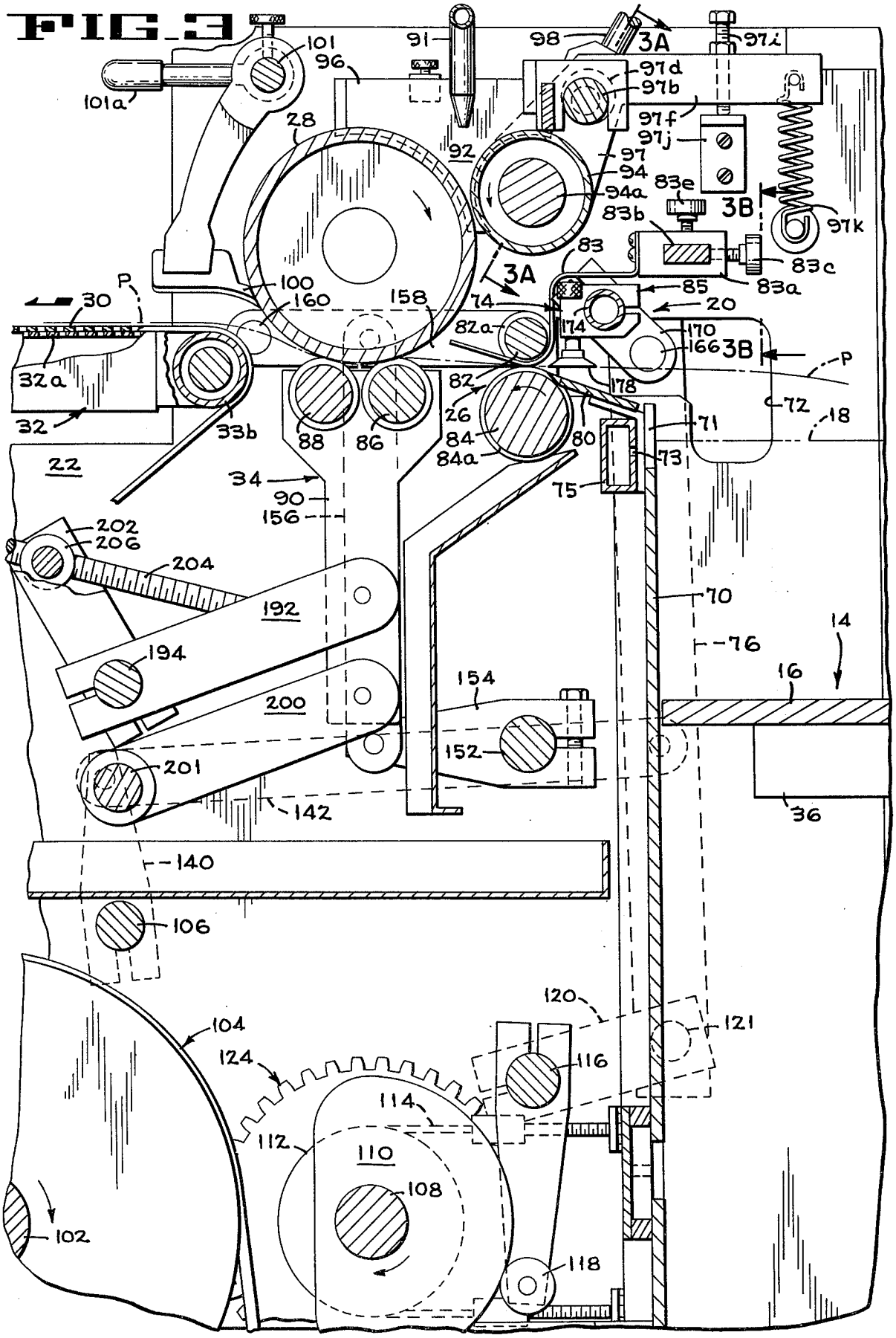
FIG. 3 is an enlarged schematic section of the general area of the gluing machine indicated by the arrow 3 on FIG. 1.

As shown in FIG. 3, a vertical, transverse wall 70 extends between the side plates 22 and 24 (FIG. 1) and defines the downstream end of the stack magazine 14. The upper end of the wall 70 is provided with vertical grooves 71 that are each aligned with an air port 73 in an air conduit 75. The ports 73 issue air blasts to riffle the sheets in the magazine each time a sheet is removed, and thus aid in separating the top sheet from the stack. The side plates each have an L-shaped aperture 72 (FIG. 3 and FIG. 5) that provide operating clearance for the mechanism that positions a vacuum head 74 that grips the top sheet for removal from the magazine. As will be described, the vacuum head 74 has an L-shaped path of movement corresponding to the side plate apertures 72. The vacuum head 74 is carried by an upstanding pivot link 76 (FIGS. 3 and 4) and a corresponding, laterally aligned link 78 at the other side of the gluing machine, both levers being outside the side plates 22 and 24.

Figure 3A:
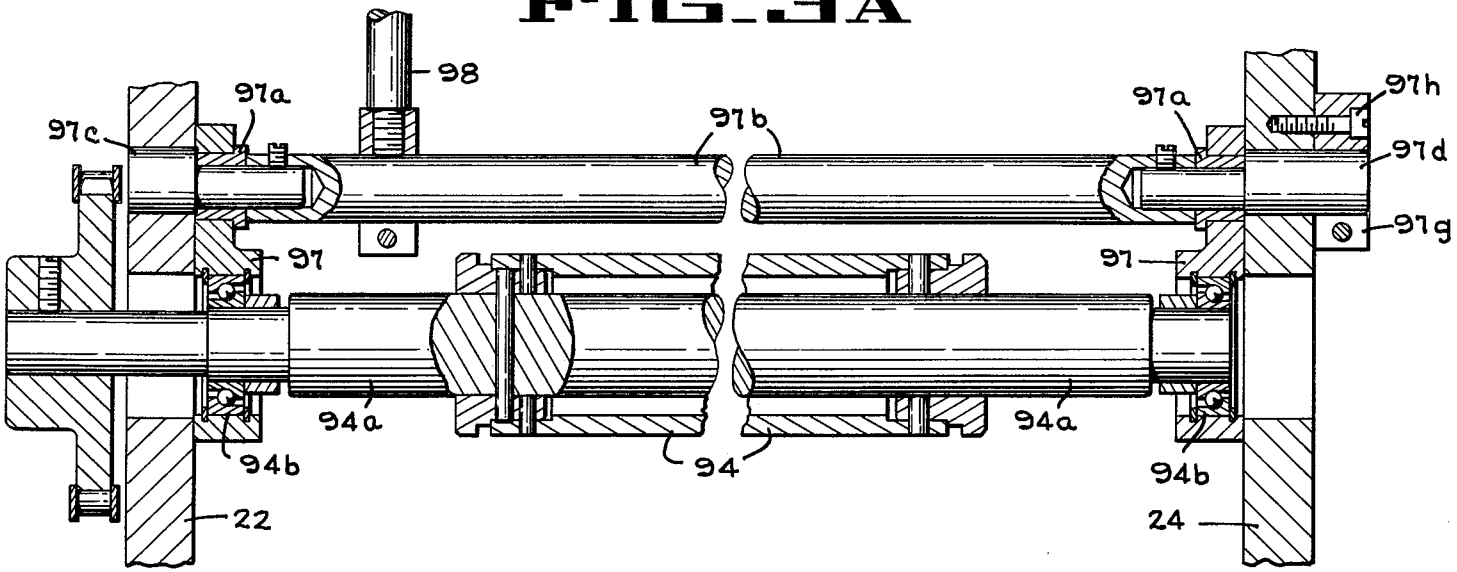
FIG. 3A is a section taken on line 3A of FIG. 3.
Figure 3B:
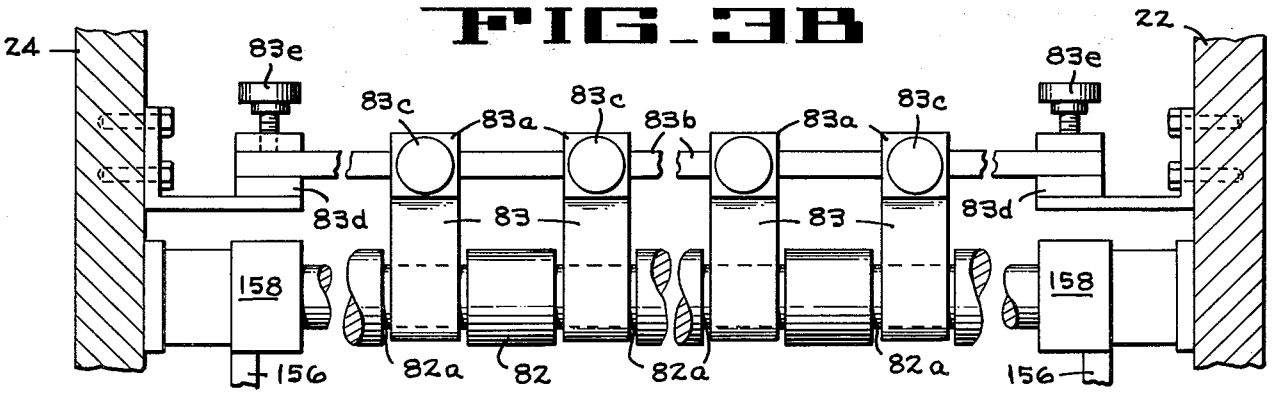
FIG. 3B is a view as indicated by line 3B of FIG. 3.

Returning to a general description of the mechanism, in FIG. 3, the vacuum head 74 is shown in its advanced position for delivering relatively thick, inflexible sheets such as cardboard to the feed rolls. The path of a sheet from the magazine 14 to the vacuum conveyor 30 approximates the broken line P. As will be described in connection with FIGS. 7–9, the vacuum head 74 initially extends across one edge of the upper sheet in the magazine, and delivers the sheet over a ramp 80 and between upper and lower feed rolls 82 and 84. Both feed rolls are provided with circumferential grooves, 82*a*, 84*a* that are aligned with individual vacuum cup units 85. Referring to FIGS. 3 and 3B, stripper or guide fingers 83 are mounted and curved so as to ride in the grooves 82*a* of the upper feed roll 82, with their free ends projecting toward the glue roll 28. Each stripper finger is secured to a yoke 83*a* which yoke is slidably mounted on a cross bar 83*b*. Each yoke is adjustably secured to the cross bar 83*b* by a set screw 83*c* mounted in the yoke. As seen in FIG. 3B, each end of the cross bar 83*b* is mounted in a bracket 83*d* secured to the sideplates 22, 24. Set screws 83*e* secure the ends of the cross bar 83*b* in their respective mounting brackets 83*d*.

In order to assure easy entry of the sheets between the feed rolls, the upper (idler) roll 82 is raised from the lower (driven) roll 84 until the leading edge of the sheet is in position to be gripped by the feed rolls, at which time the upper roll 82 is lowered into contact with the sheet while the vacuum head 74 returns toward the magazine to pick up the next sheet. The leading edge of the sheet progresses under the glue roll 28 and over two parallel presser rolls 86 and 88 of the presser assembly 34. The ends of the presser rolls are removably mounted in upstanding yokes 90 (FIGS. 3 and 4) that may be vertically adjusted to regulate the clearance between the glue roll and presser rolls.

As best seen in FIG. 3, glue is delivered from overhead conduits 91 into a trough 92 formed by a glue spreader roll 94 and the glue roll 28, and by a fixed upright wall 96 (only one being shown) at each end of said rolls. The walls 96 have arcuate lower edges, which extend into grooved portions of the rolls 28, 94.

Means are provided to precisely adjust the spacing of the spreader roll 94 from the glue roll 28. Referring to FIGS. 3 and 3A, each end of the glue roll shaft 94*a* rotates in a bearing 94*b* (FIG. 3A) which in turn is mounted on one arm 97 of a bell crank lever (FIG. 3). The bell crank levers are pivotally mounted by means of bushings 97*a* (FIG. 3A) that are concentric with an adjusting shaft 97*b*. Secured by setscrews to opposite ends of the shaft 97*b* are eccentrics 97*c* and 97*d* which eccentrics are rotatably mounted in the frame side plates 22, 24. The eccentric 97*d* projects past the sideplate 24 and turns within a split clamp 97*g* which is secured to the side plate 24 at 97*h*. This clamp holds the eccentrics in their adjusted position. As seen in FIG. 3, a second arm 97*f* of each bell crank lever mounts an adjustable stop screw 97*i* and this screw bears against an angle bracket 97*j* secured to the associated side plate 22. A similar arm screw and bracket assembly is mounted on the opposite side plate 24. Springs 97*k* urge the stop screws 97*i* against their stop plates 97*j*. An adjustment handle 98 projects from the cross shaft 97*b*. Because of the eccentric mounting of the shaft 97*b* just described, when the clamp 97*g* is loosened, the angular position of the handle 98 precisely determines the gap between the spreader roll 94 and the glue roll 28. This adjustment can be equalized along the rolls by individual adjustment of the two stop screws 97*i*. These stop screws also provide a coarse adjustment of the gap between the roll 94 and the roll 28. After adjustment the clamp 97*g* is re-tightened against the eccentric 97*d*. The spreader roll 94 is driven by a chain and sprocket assembly, the details of the drive not being critical to the present invention.

On the downstream side of the glue roll 28, a series of stripper fingers 100 (FIG. 3) depend from a pivotally mounted support rod 101 to assure that the sheets are directed toward the vacuum belt conveyor 32 and do not wrap around the glue roll 28. The fingers 100 can be raised by a handle 101*a* connected to the rod 101. Other parts appearing in FIGS. 3 and 4 include a main input shaft 102 that is driven by a belt and pulley drive train 104 from the motor M1 (see also FIG. 1). Above the input shaft 102 is an oscillating equalizer shaft 106 which serves to transmit driving motion to the upright links 76, 78 for the vacuum head 74, as will be described in detail presently. A cam shaft 108 carries a series of cams, one cam 110 (FIG. 4) providing up and down motion for the vacuum head 74. A friction brake, including a drum 112 on the cam shaft 108, and a friction band 114 trained over the drum, serves to inhibit rotation of the cam shaft for preventing overtravel of components which are driven thereby. Adjacent the cam shaft 108 is a rocking cross shaft 116 having a cam follower 118 riding on the cam 110, and having spaced crank arms 120 pivotally connected by a shaft 121 to the upright link 76 which carries one end of the vacuum head 74. The rear side link 78 (FIG. 4) for the other end of the vacuum head is pivoted at 122 between similar spaced crank arms 123 on the other end of the pivot shaft 116.

Figure 4:
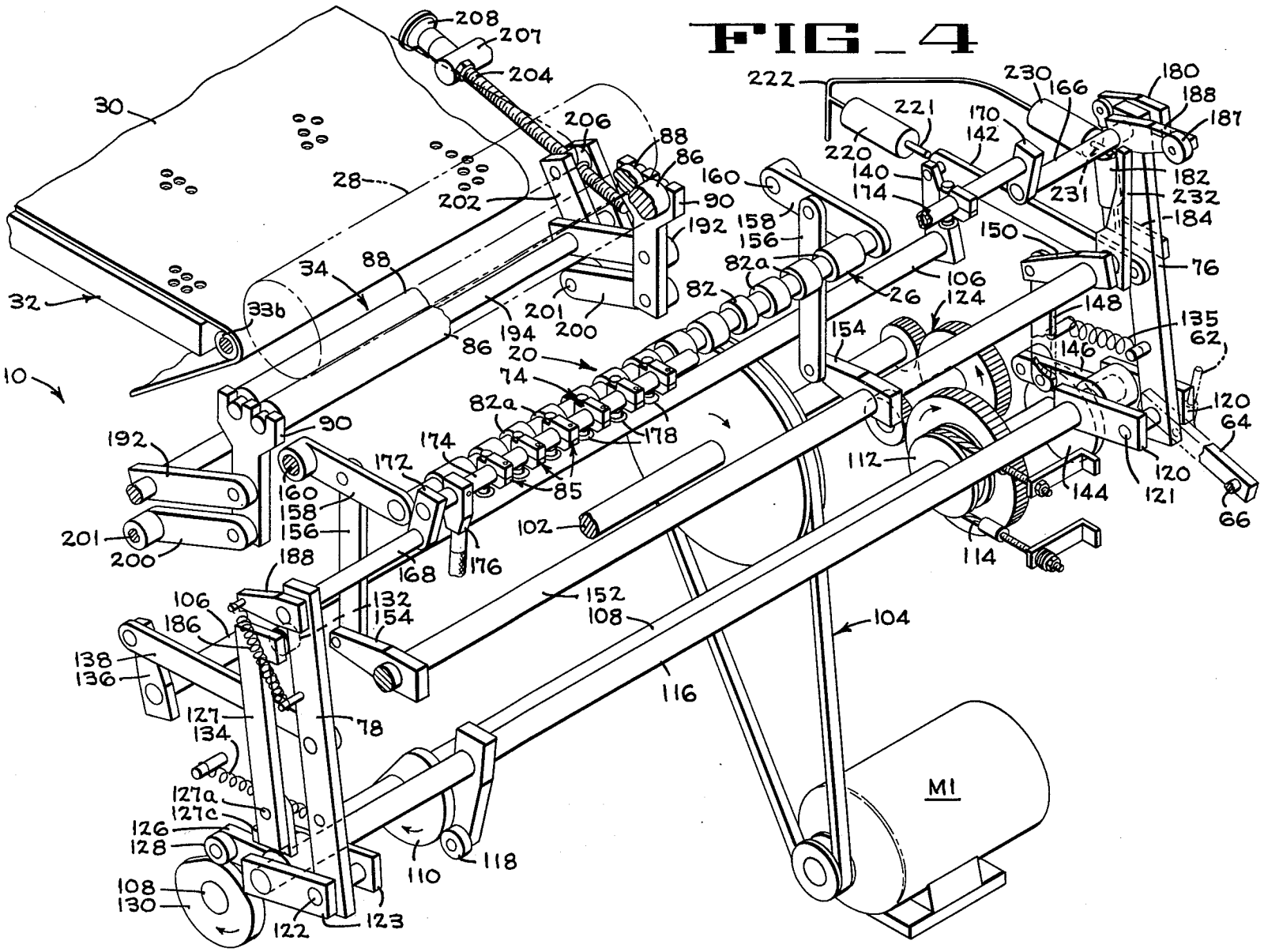
FIG. 4 is an enlarged schematic perspective of the major drive and operating components of the gluing machine.
Figure 5:
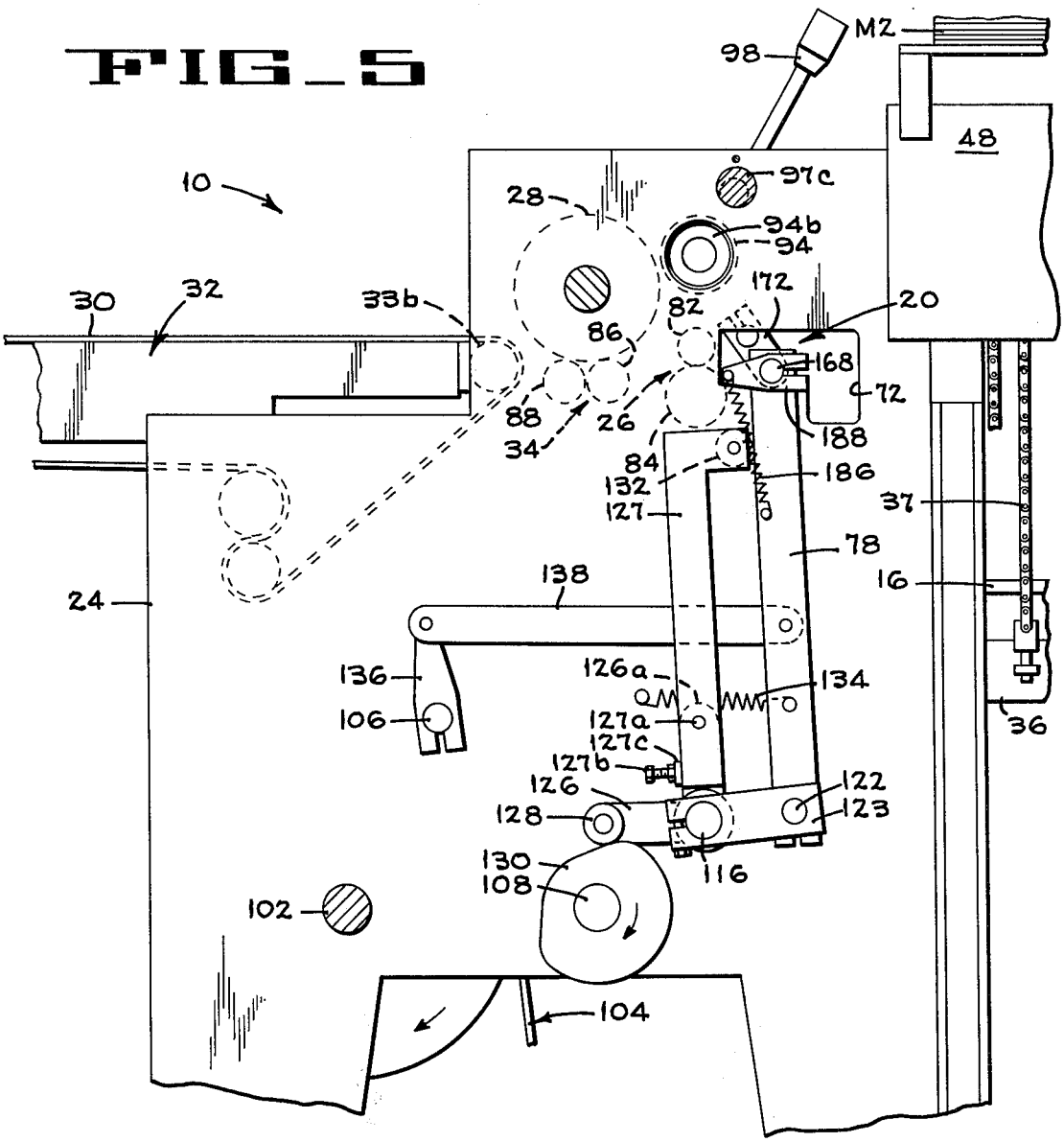
FIG. 5 is an enlarged schematic elevation of the central portion of FIG. 1.
Figure 5A:
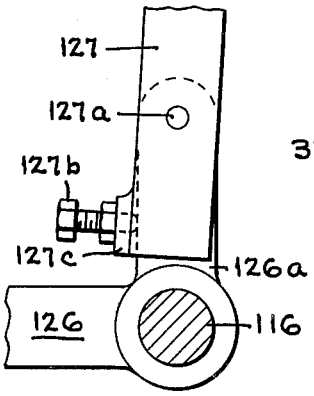
FIG. 5A is an enlarged fragmentary view of the pusher arm adjustment for the vacuum cups.

FIG. 4 also illustrates major drive and operating components of the gluing machine 10. As mentioned, the main drive input shaft 102 is driven by a belt and pulley assembly 104 and the motor M1. A gear train 124 interconnects the shaft 102 and the cam shaft 108. For providing fore and aft rocking movement of the vacuum head 74, a bell crank arm 126 is pivotally mounted on the cross shaft 116, (also see FIG. 5A). The bell crank 126 has an upwardly projecting crank arm 126*a* (FIGS. 5 and 5A) which pivotally mounts an upwardly projecting pusher arm 127 (see also FIG. 4) at 127*a*. An adjustable stop bolt 127*b* (FIG. 5A) is threaded into an ear 127*c* on the arm 127 and the bolt abuts the lower end of the crank arm 126*a*. This provides an adjustment for the arm 127. A cam follower roller 128 (FIGS. 4 and 5) on the outer end of crank arm 126 rides on a cam 130 fixed to the cam shaft 108. A roller 132 on the upper end portion of the pusher arm 127 engages the upright link 78 that carries one end of the vacuum head 74. An anchored tension spring 134 biases the link 78 against the roller 132 on the pusher arm 127, thereby urging the stop bolt 127*b* against the bell crank arm 126*a*, which in turn urges the follower roller 128 on the bell crank arm 126*a* against the cam 130. A similarly functioning spring 135 (FIG. 4) biases the upright link 76 connected to the opposite end of the vacuum head.

Only one cam is required to swing the vacuum head 74 fore and aft. This is the cam 130 on the shaft 108 (FIG. 4) which operates the pusher arm 127 and the upright link 78, as described in order to swing the vacuum head 74 fore and aft. In order to facilitate the use of a single cam 130 for this purpose, the equalizer shaft 106 is connected to the upright link 78 by a crank arm 136 and a horizontal link 138, (FIG. 4). The other end of the equalizer shaft 106 mounts a crank arm 140 which is connected by a horizontal link 142 to the upright link 76 for the other end of the vacuum head 74. Thus shaft 106 equalizes the motion of the upright links 76 and 78 and prevents the vacuum head 74 from skewing and misaligning the sheet.

As mentioned, (FIG. 4) the crank arms 123 and 120 that lift the vacuum head are formed as spaced levers connected to shaft 116. Levers 123 accommodate the hub of the bell crank 126, and the levers 120 accommodate the hub of a cam follower arm 146, to be described. The pivot 121 of the levers 120 not only operates the upright link 76, but actuates the free end of the trip arm 64. Thus, when the vacuum head 74 is swung forward and rearward, the trip arm 64 is pivoted upward and downward. This motion, as explained, cyclically operates the microswitch 68 (FIG. 2) to incrementally raise the stack of sheets on the magazine table 16 and place the uppermost sheet in delivery position after each time a sheet is removed.

Returning to FIGS. 4 and 10, a feed roll lift cam 144 is mounted on the far end of the cam shaft 108 for raising and lowering the upper feed roll 82 each time a sheet is fed thereto by the vacuum head 74. Thus, the cam 144 raises and lowers the follower arm 146 that is pivotally mounted on the pivot shaft 116 between the arms 120 and is coupled to a vertical link 148. The link 148, in turn is pivotally connected to a crank 150 fixed on a rockshaft 152 (FIG. 12). The rockshaft carries two arms 154, each of which is coupled by a link 156 to the central portion of a generally horizontal arm 158. One end of each arm 158 is mounted on a fixed pivot shaft 160 (see also FIG. 3) and the other end of each arm 158 supports the upper feed roll 82. With this arrangement, and the timing employed, the upper (idler) feed roll 82 is elevated from the driven feed roll 84 to permit easy entry of the leading edge of a sheet delivered by the vacuum head 74 and then lowers to grip the sheet against the driven roll 84 (FIG. 3) in order to drive the sheet past the glue roll 28.

The vacuum head 74 is connected to the upright links 76 and 78 by coaxial, rotatable stub shafts 166 and 168, respectively, which extend through the angled slots 72 (FIGS. 3 and 5) in the side plates 22 and 24. Upwardly directed and aligned arms 170 (FIG. 4) and 172 on the stub shafts 166, 168 are fixed to a vacuum tube 174 having closed ends and a vacuum connector 176 near one end. Mounted along and communicating with the vacuum tube 174 is a spaced series of the vacuum cup units 85, each having a depending suction cup 178 for gripping engagement with a sheet.

The vacuum head 74 is selectively rotatable about the axes of the stub shafts 166 and 168 while the vacuum head is moving fore and aft by the upright links 76,78. To effect such rotation, the stub shaft 166 is connected to a lever 180 (FIGS. 4 and 10) which is pivoted to the piston rod of an air cylinder 182. The base of the cylinder 182 is mounted to a bracket 184 (also shown in FIG. 7) which is welded to the upright link 76.

In this way, projecting movement of the piston rod of the cylinder 182 directly rotates the vacuum head stub shaft 166 (and indirectly rotates the other stub shaft 168) to swing the arms 170 and 172, thereby swinging the vacuum cups 178 to the left, as viewed in FIG. 3. A retracting spring 186 (FIG. 4) is connected to a lever 188 fixed to the stub shaft 168 and is also connected to the upright lever 78. This biases the vacuum cup units 85 (when the air cylinder 182 is de-energized) to bring a roller 187 on an arm 188 fixed to the stub shaft 166 (FIGS. 4 and 10) against a cam plate 189 (FIG. 10) on the side plate 22. The cam plate 189 is inclined, so that as the vacuum cup units are advanced toward the feed rolls 82 and 84 (to the right in FIG. 10) the vacuum cups are lifted somewhat.

When the sheets to be glued are relatively flexible, as described in connection with FIGS. 7 – 9, the vacuum cups are rotatively lifted by the air cylinder 182 and the roller 187 clears the cam plate 189.

It was previously mentioned that the presser rolls 86 and 88 (FIGS. 3 and 4) are vertically adjustable relative to the glue roll 28. As shown in FIG. 4, each of the presser roll support yokes 90 is provided with upper parallelogram links 192 secured to a cross shaft 194 for coextensive movement of said links, and with lower parallelogram links 200 mounted on pivot studs 201. The cross shaft 194 has a bifurcated bracket 202 secured thereto, and a rod 204 is threaded through a nut 206 pivoted in the bracket. An unthreaded portion of the rod, adjacent a handwheel 208, extends through and is axially anchored in a fixed boss 207. Rotation of the handwheel 208, accordingly, rotates the cross shaft 194 and simultaneously raises or lowers the presser rolls 86 and 88 with substantially vertical movement, and allows the running clearance relative to the glue roll 28 to be adjusted with or without the gluing machine in operation. As mentioned, the presser rolls 86, 88 are used when running relatively inflexible sheets to assure close contact of the sheets with the glue roll 28.

Figure 6:
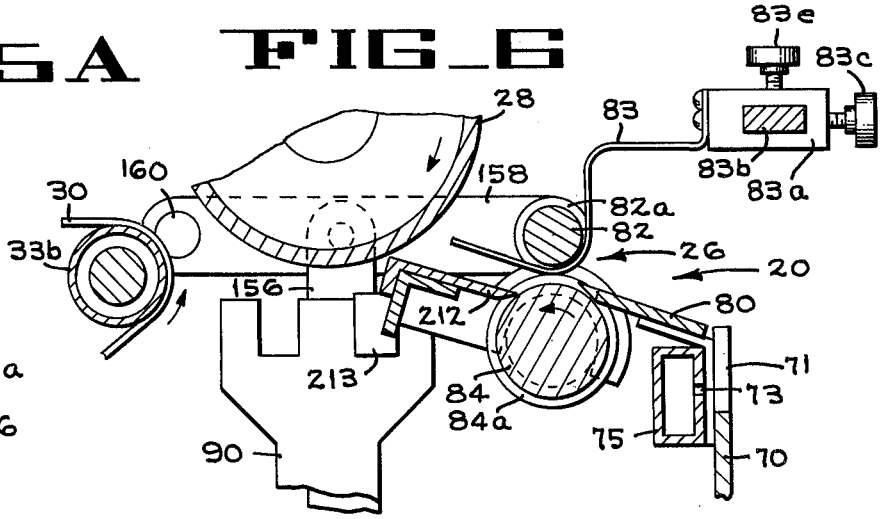
FIG. 6 is a fragmentary schematic section illustrating conversion parts used for handling thin, flexible sheets.

In those instances where flexible sheets are being run, box wrappers for example, the presser rolls 86 and 88 are removed from the yokes 90, as shown in FIG. 6. In place of the upstream presser roll 86, the bridge or ramp 212 is mounted across the two yokes 90 by a cross bar 213. The delivery path of the sheets over the ramp 212 causes flexible sheets to establish a close wrap under the lower sector of the glue roll 28 without requiring the presser rolls 86, 88.

Means are provided, under control of the operator, to retract the vacuum cups units from the feed rolls 82, 84 and to raise the upper feed roll 82 in order to facilitate clearing of jams in this area that might occasionally occur. As seen in FIGS. 4, 10 and 11, a single acting air cylinder 220 is disposed adjacent the end of one horizontal link 142 that is connected to the upright link 76 which controls the advance and retraction of the vacuum cup units 85. The piston 221 of the air cylinder is disposed for pushing on the link 142 when the air cylinder is connected to a source of air under pressure. An air line 222 leads from a control valve 224 to which is connected a line 226 from a source of air under pressure. When the valve 224 directs air to the cylinder 220, the piston 221 moves the link 142 to the left as seen in FIG. 10 and to the right as seen in FIG. 4. This motion, through linkage previously described, shifts the upright links 76 and 78 to the position shown in FIG. 11 wherein the vacuum cups 178 are retracted from the feed rolls 82, 84.

A similar system is provided to raise the upper feed roll 82 in case of jam. A second single acting air cylinder 230 has a piston 231 which is arranged to push against an upright crank 232 secured to the rock shaft 152. The air line 222 leading to the vacuum cup retracting cylinder 220 also directs air under pressure to the feed roll lifting cylinder 230. When the cylinder 230 receives air under pressure, the crank 232 is pivoted to the left, as viewed in FIG. 10 and to the right as viewed in FIG. 4. This motion rocks the shaft 152 and causes the crank arms 154 on that shaft to lift the upper feed roll 82 through linkage 156, 158 as previously described. If desired, the vacuum cups can be further raised for clearing jams by directing air to the cylinder 182 that independently rotates the vacuum cups about their stub shafts 166, 168.

OPERATION

Figures 7, 8, 9:
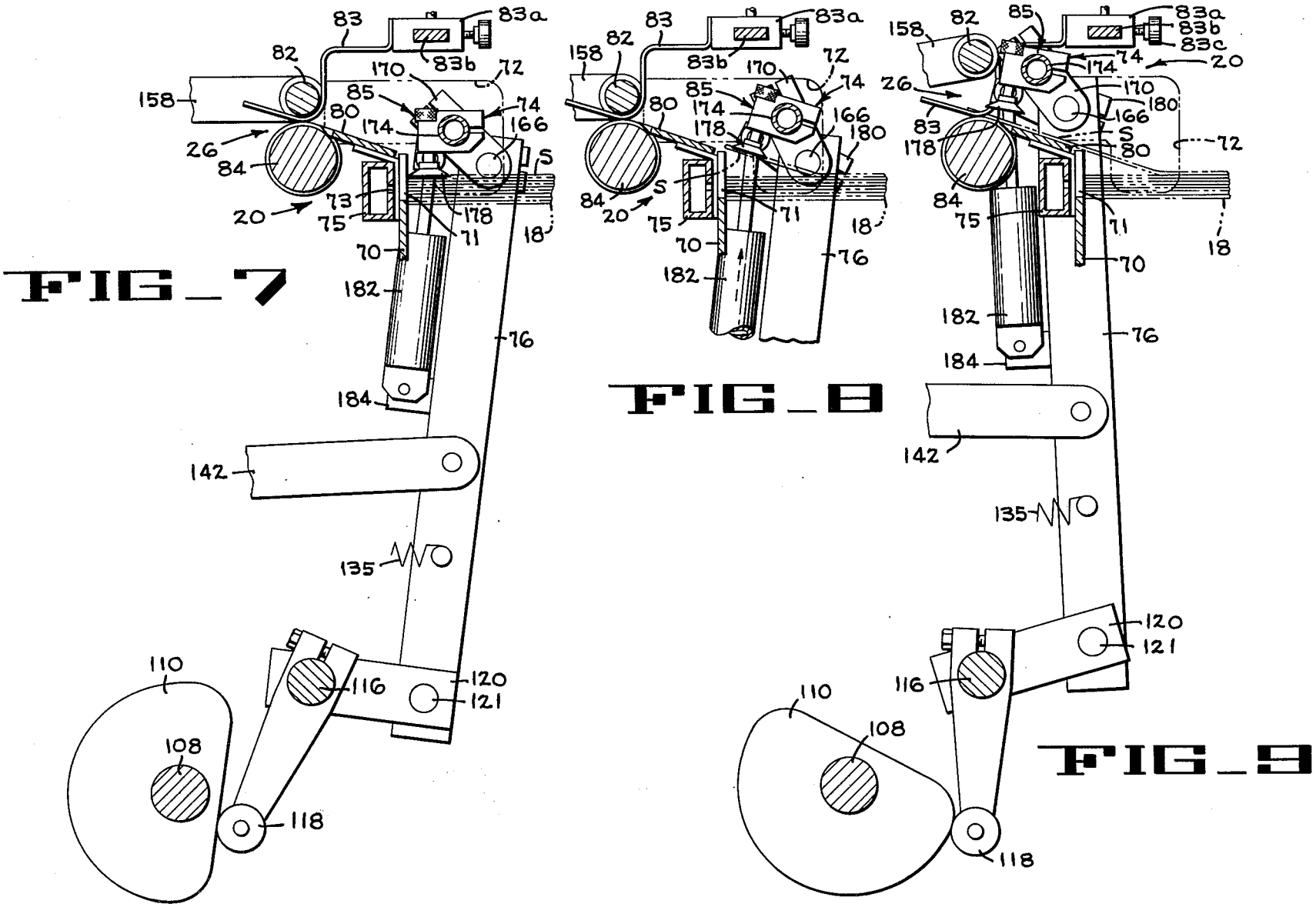
FIGS. 7–9 are schematic, fragmentary sections illustrating successive operational positions of the sheet feeding mechanism shown in FIG. 2.

FIGS. 7 – 9 shows successive operational positions for running flexible sheets S. Under these conditions, the vacuum head 74 is rotated during the delivery of each sheet to the feed rolls 82 and 84, so that the leading edge portion of the sheet is flexed upward to clear the ramp 80. Because the sheet can be thus flexed, the suction cups 178 will maintain flat engagement with the sheets, even though the vacuum head is rotated. On the other hand, a relatively inflexible sheet (especially of short dimensions longitudinally of the machine) is liable to break away from the vacuum cups if the vacuum head is rotated because the sheet cannot bend. Therefore, in the latter case, the air cylinder 182 is rendered inactive by opening a bleed outlet, not shown, to keep the piston rod of the air cylinder in its retracted position, and to keep the angular relation of the vacuum head 74 to the pivot lever 76 (and lever 78 FIG. 4) substantially as illustrated in FIG. 7.

It will be recognized that there is no exact line of demarcation between a so-called flexible sheet and an inflexible sheet. For this reason, the vacuum cups 178 can be fitted with rubber hoods (not shown) which may be manually placed on the cups 178 so that the hoods will flex and accommodate small differences of planarity between the suction cups and sheets which are somewhat inflexible, but which bend sufficiently to provide a feeding operation without rotation of the vacuum head 74 as described. Thus, it is preferred that the sheet-contacting surfaces of the vacuum cups 178 are rigid for handling paper, and that flexible accessory hoods as described be provided for handling cardboard, because this in addition to the other provisions described, provides optimum handling efficiency throughout the flexibility range of the sheets.

Again referring to FIG. 7, a sheet feeding operation begins with the vacuum head 74 in its rearmost and lowermost position, as respectively effected by the cam 130 (FIG. 4) and the cam 110 (FIGS. 4 and 7). This places the vacuum cups 178 in gripping contact with the leading edge portion of the uppermost flexible sheet S. At this time, the air conduit 75 directs high velocity air blasts from the multiple air ports 73 into the adjacent edge of the stack of sheets to aid in separating the top sheet from the stack. Before the vacuum head is moved upward from the FIG. 7 position, the air cylinder 182 is energized to swing the vacuum cup units 85 upward and rearward, thus flexing the leading edge portion of the top sheet S into a gradual bend and into general parallelism with the ramp 80 as shown in FIG. 8. The cam 110, meanwhile, is rotating to advance its highest profile past the cam follower roller 118. Accordingly, an intermediate rotational position of the cam 110, which position occurs between the operational stages shown in FIGS. 8 and 9, swings the crank arm 120 and rocks the pivot shaft 116 to elevate the upright pivot link 76 (and the counterpart link 78, FIG. 4) to raise the vacuum head 74 for forward movement at the approximate elevation shown in FIG. 9.

When the vacuum head is sufficiently raised for forward movement, the lowest profile of the cam 130 (FIG. 4) moves under the follower roller 128, thus allowing the tension springs 134 and 135 to urge the upright pivot links 76 and 78 forward, carrying the vacuum head 74 toward the feed rolls 82 and 84. Equal movement of the ends of the vacuum head 74 is achieved by means of the stabilizer or equalizer shaft 106 (FIG. 4) which, by means of the arms 136 and 140, and the links 138 and 142, ties the upright pivot links 76 and 78 together for unitary movement. While the vacuum head is being thus moved forward, the upper feed roll 82 (FIG. 9) is raised from the lower feed roll 84 to assure a wide entry throat for the sheet. Thus, the cam 144 on the far end of shaft 108 (FIG. 4) with its associated follower 146, link 148 and crank arm 150 rotates the rock shaft 152, whereby the crank arms 154 and upright links 156 pivot the carrier bars 158 to lift the feed roll 82. The components described assume the FIG. 9 position whereupon the sheet S is released by the vacuum head, ready to be gripped by the feed rolls.

The cam 144 (FIG. 4) then lowers the upper feed roll 82 so that the gripped sheet S progresses forward under the glue roll 28 (FIG. 6). The vacuum head 74 now follows a generally reverse path of movement (rearward and downward) and is returned to the FIG. 7 position, ready for gripping and transporting the next top sheet from the stack magazine.

The feeding operation when handling cardboard or other relatively inflexible sheets is reviewed in brief outline in conjunction with FIG. 3. The bridge 212 (FIGS. 6 – 9) is removed and the presser rolls 86 and 88 are mounted in the yokes 90 (FIGS. 3 and 4). Air cylinder 182 is valved so that it will not extend and the vacuum head 74 will therefore, as previously mentioned, move up and down, and fore and aft while maintaining the approximate angular orientation with the levers 76, 78 shown in FIG. 3. Thus, the sheet pickup position of the vacuum head 74 for stiff sheets is as shown in FIG. 7 for the flexible sheets. However, the vacuum head is still raised bodily by the cam 110 and its angularity is continued by forward motion toward the feed rolls 82, 84 by the cam 130 (FIG. 4) as before.

The edge profile of inflexible sheets will assume the approximate contour of the delivery path P (FIG. 3). In other words, the sheet will flex from a position farther upstream in the magazine when the downstream edge is raised by the vacuum cups 178, with the separation of the sheet from the stack aided by the air jets from the ports 73, as before. Accordingly, the path P over the stack will vary somewhat according to the flexibility and length of the sheets longitudinally of the machine, and short sheets will tend to break away from the vacuum cups 178 unless the previously mentioned flexible rubber hoods (not shown) are placed thereon so that the suction cup hoods conform to the plane of the sheet.

The upper feed roll 82 is lifted to receive the sheet, as in FIG. 9 and is then lowered to advance the sheet as the vacuum head 74 returns to the FIG. 7 position. The moving sheet contracts the driven glue roll 28 and passes thereunder while being flexed by the presser rolls 82 and 84 to provide continuous running flexure of the sheet into contact with the glue roll. Depending upon the flexibility of the sheets being handled, the leading end of the sheet may clear the elevationally adjustable vacuum belt conveyor 3. If very stiff sheets do not clear, the conveyor 30 is lowered below the position shown in FIG. 3. In either event, the sheets are glued and transported in substantially planar condition.

From the preceding detailed description, it is believed evident that the gluing machine 10 of the present invention is capable of handling sheets within a wide range of flexibility and/or thickness, and required only minimum labor and parts to accommodate that range.

Although the best mode contemplated for carrying out the present invention has been herein shown and described, it will be apparent that modification and variation may be made without departing from what is regarded to be the subject matter of the invention.

What I claim is:

1. In a gluing machine of the type including a frame, a magazine for supporting an upright stack of sheets, a vacuum head for removing the uppermost sheet from the magazine at a pickup position and feeding it from the stack to a sheet delivery position, feed rolls for gripping and transporting the fed sheet, a glue roll in rolling contact with said sheet for depositing a film of adhesive thereon, a sheet support device beneath said glue roll and a conveyor for transporting the coated sheet to a downstream station; the improvement comprising laterally spaced upright lever means, means for pivotally mounting one end of said lever means for coaxial swinging movement of the other end substantially along the path of the sheet between a rearward sheet pickup position over the magazine and a forward sheet delivery position; means for swinging said lever means about said pivot means between advanced and retracted position, a rock shaft mounted in said frame, crank means on said rock shaft connected to the associated pivot means of said lever means for raising and lowering said lever means by oscillation of said rock shaft and independently of the swinging movement of said lever means, continuously operating power means for oscillating said rock shaft, shaft means for mounting said vacuum head rotatably mounted on the other ends of said lever means, said shaft means having laterally spaced arms mounting an offset vacuum tube that carries said vacuum head, and means for independently turning said shaft means to control the position of said head.

2. The machine of claim 1, comprising power operated means for raising and lowering one of said feed rolls during normal operation, manually controlled means for independently raising said one of said feed rolls during a jam and manually controlled means for independently swinging said lever means to a retracted position during a jam.

3. The machine of claim 1, wherein said means for turning said vacuum head shaft means comprises selectively operable power means mounted on said lever means and connected to said vacuum head shaft means for selective rotation of said vacuum head shaft means for independently raising said vacuum head.

4. In a gluing machine of the type including a frame, a magazine for supporting an upright stack of sheets, a vacuum head for removing the uppermost sheet from the magazine at a pickup position and feeding it from the stack to a sheet delivery position, feed rolls for gripping and transporting the fed sheet, a glue roll in rolling contact with said sheet for depositing a film of adhesive thereon, a sheet support device beneath said glue roll and a conveyor for transporting the coated sheet to a downstream station; the improvement comprising laterally spaced upright lever means, coaxial pivot means for pivotally mounting one end of each lever means for independent swinging movement of the other end substantially along the path of the sheet between a rearward sheet pickup position over the magazine and a forward sheet delivery position; a rotatable power driven shaft mounted in said frame, a single cam on said power shaft for swinging one of said lever means about its pivot means, cam follower means between said cam and one of said lever means, an equalizer shaft mounted in said frame parallel to said power shaft, cranks on the end of said equalizer shaft, link means connected between each crank and an associated lever means for causing the other of said lever means to follow the swinging motion of said one lever means, shaft means rotatably mounted on the other ends of said lever means, and a vacuum head on said shaft means.

5. In a gluing machine of the type including a frame, a magazine for supporting an upright stack of sheets, a vacuum head for removing the uppermost sheet from the magazine and displacing it from the stack to a sheet delivery position, feed rolls for gripping and transporting the displaced sheet, a glue roll in rolling contact with said sheet for depositing a film of adhesive thereon, and a take-away conveyor for transporting the coated sheet to a downstream station; the improvement comprising; means for mounting said feed rolls, said glue roll and said conveyor to provide a substantially linear, substantially horizontal path for each sheet during movement from said magazine to said vacuum conveyor; said glue roll being mounted over the path of said sheet; with its lower peripheral surface substantially in said path; said takeaway conveyor comprising a vacuum box with an apertured top panel and an apertured vacuum belt running over said top panel; said vacuum box comprising a longitudinal central vacuum compartment flanked by longitudinal side vacuum compartments with the latter being in communication, means for connecting a source of vacuum to said central compartment and means for connecting an independent source of vacuum to said side compartments.

6. In a gluing machine of the type including a frame, a magazine for supporting an upright stack of sheets, a vacuum head for removing the uppermost sheet from the magazine and displacing it from the stack to a sheet delivery position, feed rolls for gripping and transporting the displaced sheet, a glue roll in rolling contact with said sheet for depositing a film of adhesive thereon, and a take-away conveyor for transporting the coated sheet to a downstream station; the improvement wherein said takeway conveyor comprises a vacuum box with an apertured top panel and an apertured vacuum belt running over said top panel; said vacuum box comprising a longitudinal central vacuum compartment flanked by longitudinal side vacuum compartments with the latter being in communication, means for connecting a source of vacuum to said central compartment and means for connecting an independent source of vacuum to said side compartments.

* * * * *

UNITED STATES PATENT AND TRADEMARK OFFICE

CERTIFICATE OF CORRECTION

PATENT NO. : 4,006,704

DATED : February 8, 1977

INVENTOR(S) : GIORGIO PERONDI

It is certified that error appears in the above—identified patent and that said Letters Patent is hereby corrected as shown below:

Column 10, line 66, change "contracts" to --contacts--.

Column 11, line 4, change "3" to --30--.

Signed and Sealed this

*Twenty-third* Day of *June 1981*

[SEAL]

*Attest:*

RENE D. TEGTMEYER

*Attesting Officer* *Acting Commissioner of Patents and Trademarks*